US006471792B1

(12) United States Patent
Breedis et al.

(10) Patent No.: US 6,471,792 B1
(45) **Date of Patent: *Oct. 29, 2002**

(54) STRESS RELAXATION RESISTANT BRASS

(75) Inventors: John F. Breedis, Trumbull; Ronald N. Caron, Branford; Carl L. Deppisch, Hamden, all of CT (US)

(73) Assignee: Olin Corporation, East Alton, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/429,871

(22) Filed: Oct. 29, 1999

Related U.S. Application Data

(63) Continuation-in-part of application No. 09/192,766, filed on Nov. 16, 1998.

(51) Int. Cl.[7] ..... C22C 9/02
(52) U.S. Cl. ..... 148/433; 420/472
(58) Field of Search ..... 148/433; 420/472

(56) References Cited

U.S. PATENT DOCUMENTS

| | | | | |
|---|---|---|---|---|
| 2,028,317 | A | 1/1936 | Butterbaugh | 420/481 |
| 2,062,427 | A | 12/1936 | Pierson | |

(List continued on next page.)

FOREIGN PATENT DOCUMENTS

| | | | |
|---|---|---|---|
| EP | A2-0-795-693 | | 9/1997 |
| EP | A1-0-859-065 | | 8/1998 |
| JP | 57-2849 | | 1/1982 |
| JP | 59047751 | | 3/1984 |
| JP | 59126742 | | 7/1984 |
| JP | 59197542 | | 11/1984 |
| JP | 61127840 | | 11/1984 |
| JP | 62199741 | | 9/1987 |
| JP | 63026320 | | 2/1988 |
| JP | 1062429 | | 3/1989 |
| JP | 1068436 | | 3/1989 |
| JP | 3-2341 | | 1/1991 |
| JP | 3-87341 | | 4/1991 |
| JP | 4231430 | * | 8/1992 |
| JP | 4354843 | | 12/1992 |
| JP | 5059467 | * | 3/1993 |
| JP | 5311278 | * | 11/1993 |
| JP | 5311292 | | 11/1993 |
| JP | 6184679 | | 7/1994 |
| JP | 6-220594 | | 7/1994 |
| JP | 6-73474 | | 10/1994 |
| JP | 6299275 | * | 10/1994 |
| JP | 7126779 | | 5/1995 |

OTHER PUBLICATIONS

*New Higher Conductivity Alloys Within The Improved Phosphor Bronze and Improved Copper–Tin–Zinc Alloy Families*, by Ashok K. Bhargava, pp. 119–129, 1997.

*Primary Examiner*—Sikyin Ip
(74) *Attorney, Agent, or Firm*—Wiggin & Dana; Gregory S. Rosenblatt

(57) ABSTRACT

An alpha brass (copper/zinc alloy with less than 39%, by weight, of zinc) stock alloy has controlled additions of nickel, tin and phosphorous. The combination of nickel and tin increase resistance of the alloy to elevated temperature stress relaxation. As a result, spring contacts formed from alloys of the invention maintain a higher percentage of initially imposed stress at elevated temperatures, in the range of 125° C. to 150° C., for significantly longer times than other brass alloys of comparable strength.

8 Claims, 4 Drawing Sheets

U.S. PATENT DOCUMENTS

Figure 1:
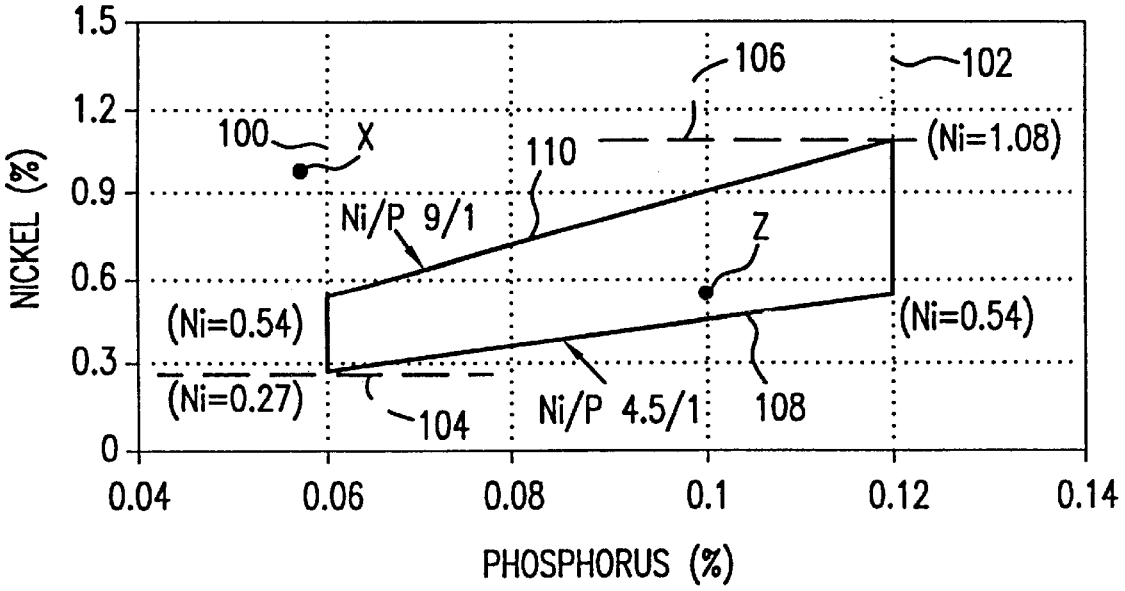

| | | | | |
|---|---|---|---|---|
| 3,375,107 | A | 3/1968 | Kranz | 420/472 |
| 4,337,089 | A | 6/1982 | Arita et al. | 420/472 |
| 4,362,579 | A | 12/1982 | Tsuji | 420/481 |
| 4,586,967 | A | 5/1986 | Shapiro | 420/472 |
| 4,605,532 | A | 8/1986 | Knorr | 420/472 |
| 4,627,960 | A | 12/1986 | Nakajima | 420/472 |
| 4,666,667 | A | 5/1987 | Kamio et al. | 420/471 |
| 4,822,562 | A | 4/1989 | Miyafuji | 420/472 |
| 4,971,758 | A | 11/1990 | Suzuki et al. | 420/472 |
| 5,024,814 | A | 6/1991 | Futatasuka | 420/473 |
| 5,334,346 | A | 8/1994 | Kim et al. | 420/485 |
| 5,507,885 | A | 4/1996 | Sakai et al. | 148/433 |
| 5,820,701 | A | 10/1998 | Bhargava | 420/472 |
| 5,865,910 | A | 2/1999 | Bhargava | 420/472 |
| 5,893,953 | A | 4/1999 | Bhargava | |

* cited by examiner

STRESS RELAXATION RESISTANT BRASS

CROSS REFERENCE TO RELATED APPLICATION

This patent application is a continuation in part of U.S. patent application Ser. No. 09/192,766 that was filed on Nov. 16, 1998. That patent application is incorporated by reference in its entirety herein.

BACKGROUND OF THE INVENTION

1. Field of the Invention

This invention relates to zinc-containing copper alloys (typically referred to as brass). More particularly, the resistance of brass to elevated temperature stress relaxation is increased by a controlled addition of alloying elements.

2. Description of Related Art

Throughout this patent application, all compositions are in weight percent, unless otherwise specified.

Alpha brasses, are single phase alloys of copper and zinc that contain up to 39% of zinc. The alloys are characterized by good formability, moderate strength, modest electrical conductivity and low cost. Their combination of strength, formability and electrical conductivity suit the alpha brasses for manufacture into electrical connectors used in appliance and automotive applications.

A limitation on the use of alpha brasses in certain connector applications is inadequate resistance to stress relaxation when the connector operating temperature is significantly above room temperature (nominally, room temperature is 20° C.). The connector operating temperature is affected by both the ambient operating temperature and resistance heating ($I^2R$) from the electrical current carried through the connector.

In one method of manufacturing an electrical connector, a wrought sheet of copper alloy is formed into a cantilever spring contact contained within a hollow box. Electrical continuity of a circuit between the connector's spring contact and a removable blade is assured when a contact force between the spring contact and the inserted blade is maintained at above a design minimum force. Under these conditions, the connection is electrically transparent.

Over time, and more rapidly at elevated temperatures, stress relaxation weakens the contact force between the cantilever spring contact and the blade and may eventually lead to connector failure through an unacceptably low contact force. It is a primary objective of electrical connector design to maximize the contact force between the cantilever spring contact and the blade to maintain a good electrical conductivity path through the connection.

The loss of more than 30% of the originally imposed stress (70% stress remaining) at the product design life (typically 3,000 hours for automotive connectors) is one commonly applied criterion for alloy selection.

Alpha brasses such as copper alloy C240 (nominal composition 78.5%–81.5% copper, balance zinc) and copper alloy C260 (nominal composition 68.5%–71.5% copper, balance zinc) satisfy the 30% loss of originally imposed stress criterion at temperatures only up to about 75° C., well below the 125° C.–150° C. highest anticipated service application temperature for a number of under-the-hood automotive applications.

The addition of other alloying elements to an alpha brass have, typically, not led to an increase in stress relaxation resistance without a significant detrimental effect on other alloy properties, such as conductivity or formability. For example, copper alloy C688 (nominal composition 22.7% zinc, 3.4% aluminum, 0.4% cobalt and remainder copper) has a 75° C. application capability, the same as copper alloy C240. While copper alloy C240 has an electrical conductivity of 32%, copper alloy C688 has an electrical conductivity of only 18% IACS. IACS stands for International Annealed Copper Standard and assigns "pure" copper an electrical conductivity value of 100% IACS at 20° C.

The addition of tin to copper alloy C220 (nominal composition 89%–91% copper, balance zinc) forms copper alloy C425 (nominal composition 9.5% zinc, 1.8% tin, balance copper). Copper alloy C425 has improved stress relaxation resistance enabling the alloy to be formed into connectors having an application temperature of 125° C. This advantage is offset by a large decrease in electrical conductivity, from 44% IACS for copper alloy C220 to 28% IACS for copper alloy C425.

U.S. Pat. No. 4,362,579 entitled "High-Strength-Conductivity Copper Alloy" by Tsuji is incorporated by reference in its entirety herein. The patent recites a copper alloy that is disclosed as having a combination of high strength, excellent electrical conductivity, corrosion resistance and spring qualities. The copper base alloy contains 0.4–8% nickel, 0.1–3% silicon, 10–35% zinc, concomitant impurities and the remainder is copper. The electrical conductivity of the disclosed alloys is relatively low, ranging from 19.1% IACS to 21.2% IACS. Additionally, the required addition of silicon typically decreases hot workability, electrical conductivity and formability.

U.S. Pat. No. 5,820,701 entitled "Copper Alloy and Process for Obtaining Same" by Bharghava discloses, in one embodiment, a copper alloy that consists essentially of 1.0%–4.0% tin, 9.0%–15.0% zinc, 0.01%–0.2% phosphorous, 0.01%–0.8% iron, 0.001%–0.5% nickel and/or cobalt and the balance essentially copper. The disclosed copper alloys contain a minimum of 1% of tin.

There remains, therefore, a need for an alpha brass base alloy having an electrical conductivity in excess of 25% IACS and sufficient resistance to stress relaxation that a connector formed from the alloy has a 3,000 hour operating life in the 125° C.–150° C. temperature regime.

SUMMARY OF THE INVENTION

Accordingly, it is an object of the invention to provide an alpha brass base alloy with improved resistance to stress relaxation and an electrical conductivity in excess of 20% IACS. It is feature of the invention that controlled amounts of nickel, tin and phosphorus are added to the base alloy. Another feature of the invention is that the alloys of the invention are capable of forming a uniform and fully recrystallized microstructure. This microstructure is characterized by a very fine grain structure with a uniform dispersion of fine phosphide particles.

Among the advantages of the alloys of the invention are that the alloys have good resistance to stress relaxation at temperatures of up to 125° C., and in certain embodiments, the resistance to stress relaxation is significant at temperatures of up to 150° C. Another advantage of the alloys of the invention is that the electrical conductivity is not significantly reduced below that of a non-modified alpha brass. Further, the alloys have good bend formability and relatively high yield strength. The alloys of the invention are particularly suitable for forming electrical connectors that are exposed to elevated temperature, such as connectors for automotive applications.

In accordance with the invention, there is provided a modified brass alloy that consists essentially of from 2% to the maximum of zinc that maintains an alpha brass microstructure, from 0.2% to 2% of nickel, from 0.15% to 1% of tin, from 0.03% to 0.35% of phosphorus and the balance is copper and inevitable impurities.

The objects, features and advantages recited above will become more apparent from the specification and drawings that follow.

IN THE DRAWINGS

FIG. 1 graphically illustrates a nickel to phosphorous content ratio in accordance with a preferred embodiment of the invention.

Figure 2:
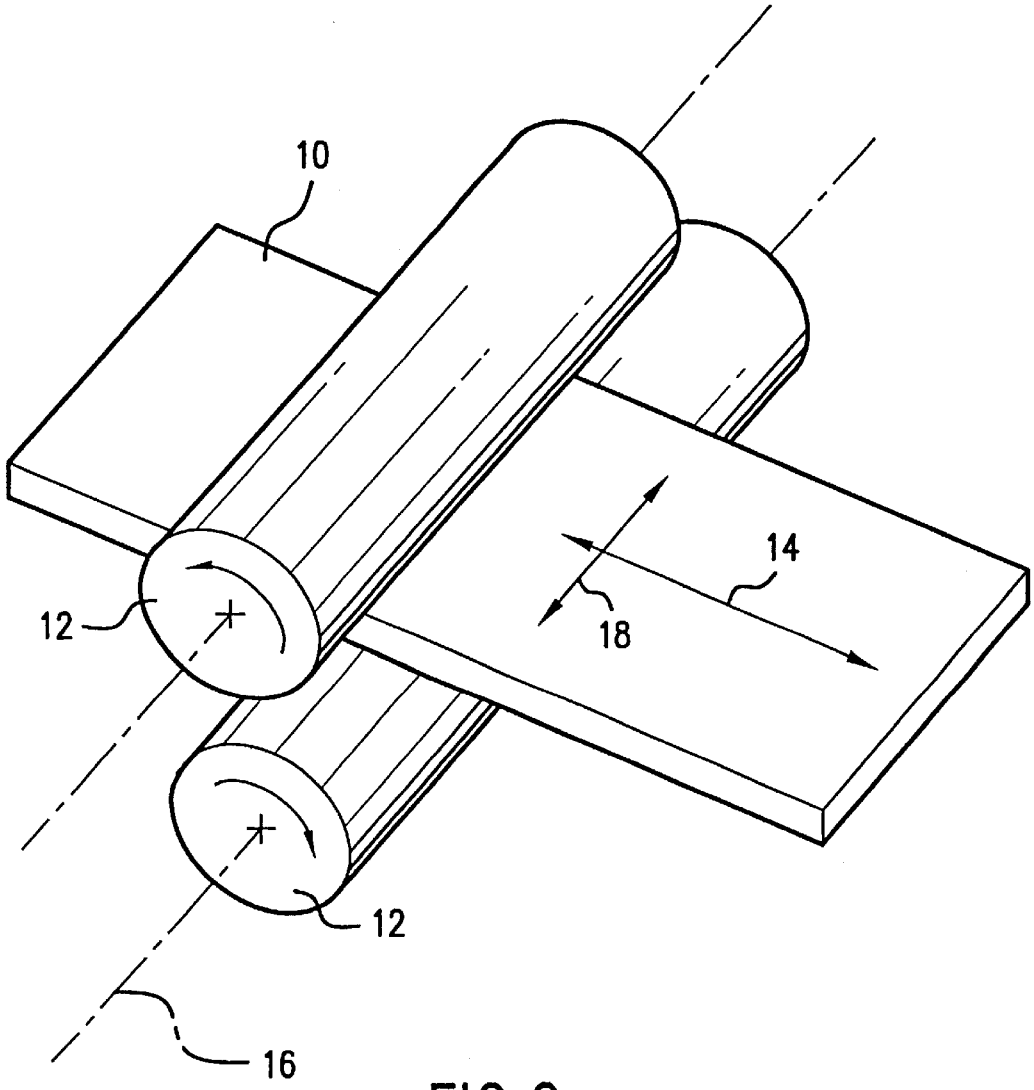

FIG. 2 illustrates the directionality of a rolled copper alloy strip.

Figure 3:
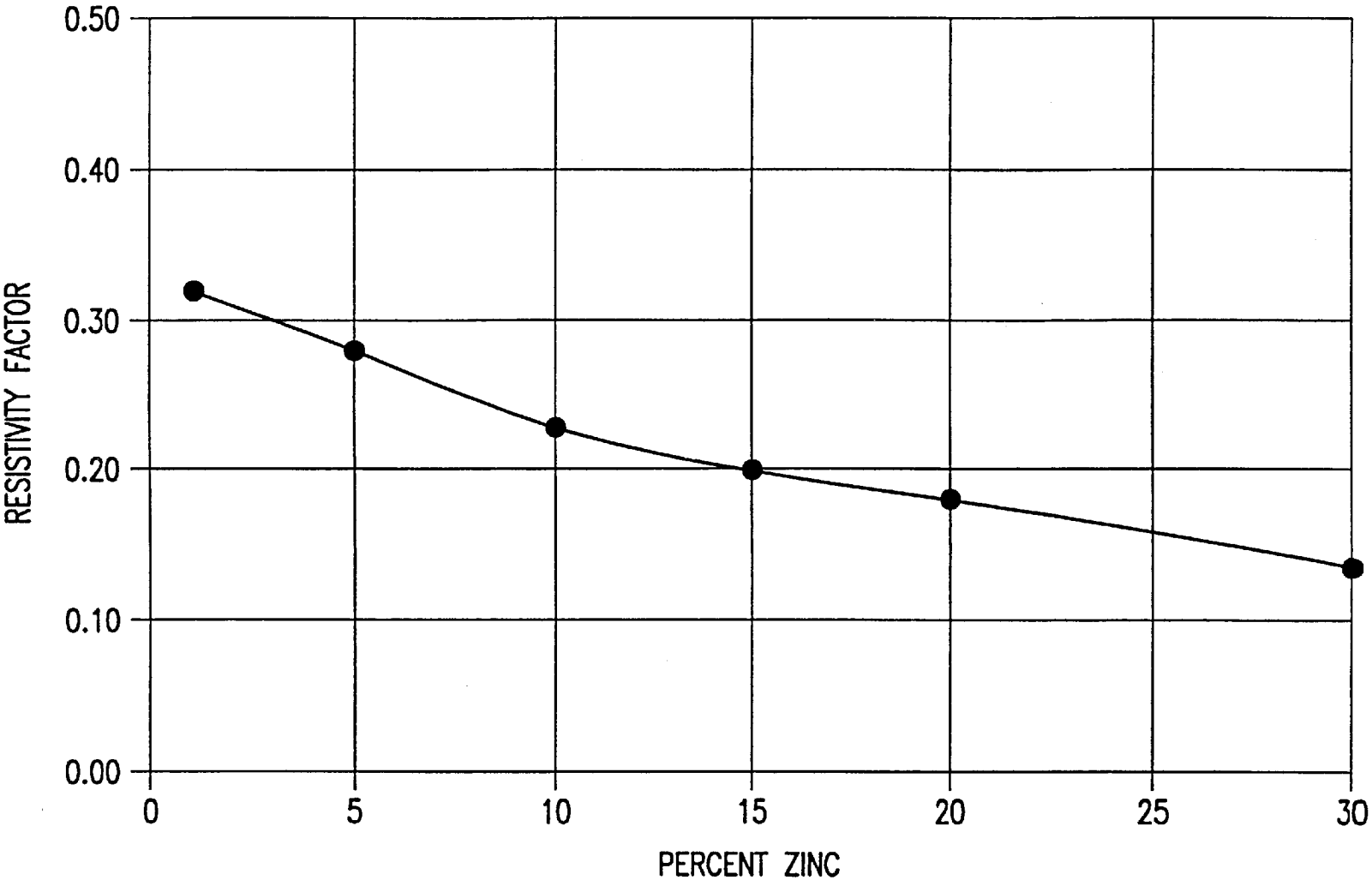

FIG. 3 graphically illustrates the effect of zinc content on the electrical resistivity factor for zinc (in micro-ohm.cm/wt. % zinc) in a binary zinc copper alloy which is a base composition for the alloys of the invention.

Figure 4:
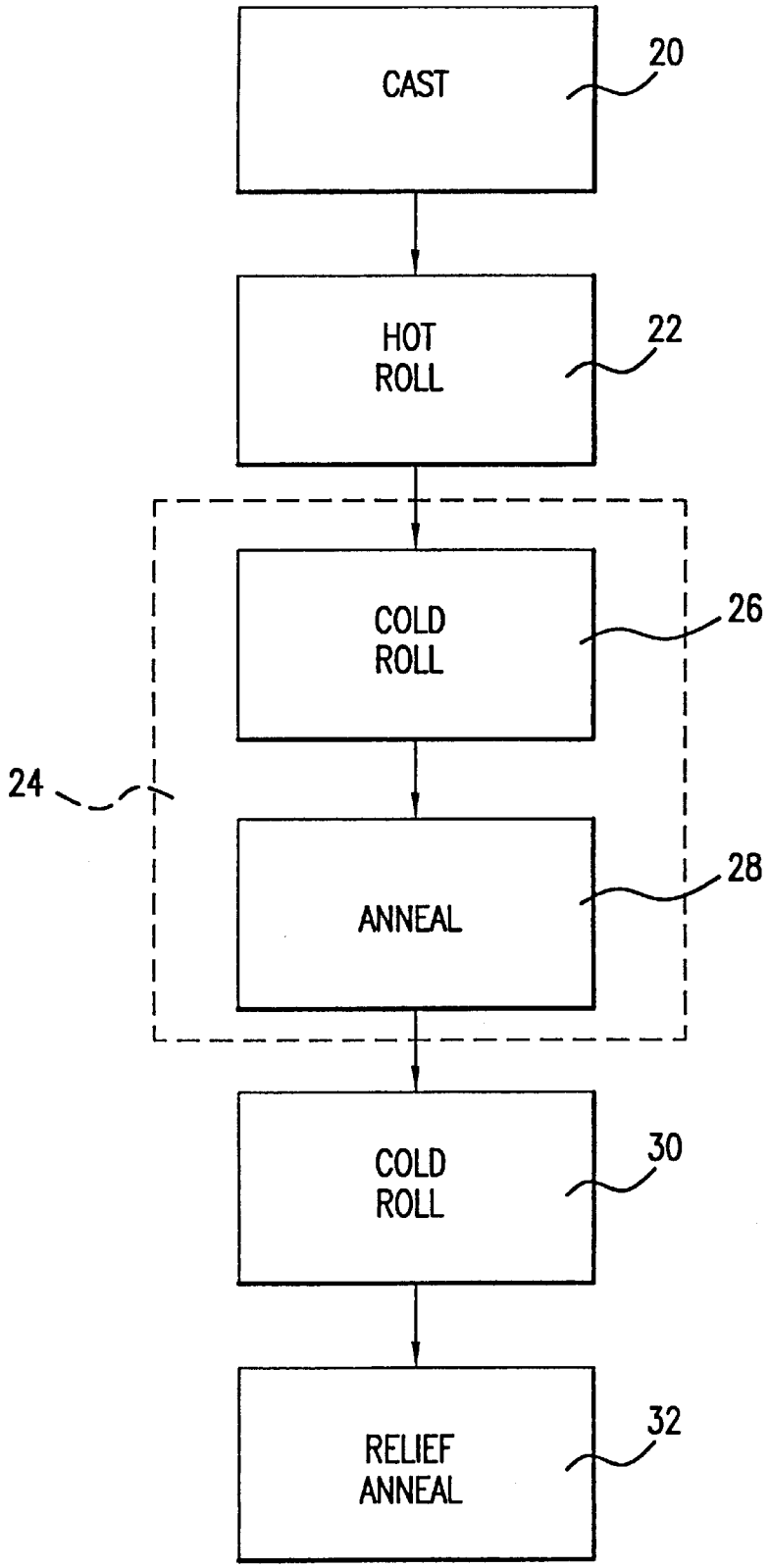

FIG. 4 illustrates in block diagram a method for processing alloys of the invention.

DETAILED DESCRIPTION

The alloys of the invention have an alpha brass base. Prior to the addition of alloying elements, the alloy is a mixture of copper and up to 39% of zinc. Controlled amounts of nickel, tin and phosphorus are added to the alpha brass base alloy.

Table 1 illustrates an interaction between nickel, phosphorus and tin when added to copper. While the properties are recorded for a zinc-free alloy, the same interaction is predicted in the alpha brass base alloys of the invention.

An addition of nickel alone, at a level of up to about 4%, has a relatively minor impact on the mechanical properties of the copper alloy and degrades electrical conductivity. When combined with an addition of phosphorous and tin, sufficient nickel is required to interact with both the phosphorus and tin. Therefore, the alloys of the invention contain as a minimum 0.2% of nickel. If the nickel content is excessive, electrical conductivity is detrimentally affected and, therefore, the maximum nickel content is limited to 2%. Preferably, the nickel content is between 0.25% and 1.5% and most preferably between 0.4% and 0.7%.

TABLE 1

NICKEL, PHOSPHORUS, TIN CONTRIBUTIONS
(Zinc-free Alloys, Cold Roll and Relief Anneal (150° C.) Temper)

| ALLOY (plus Copper) | YIELD STRENGTH (ksi) | % IACS | % STRESS REM. 150° C. X 3000 hours |
|---|---|---|---|
| 1 Ni | 55 | 58 | 36 |
| 1 Ni - 1 Sn | 67 | 40 | 80 |
| 2 Ni - 2 Sn | 79 | 25.4 | 80 |
| 1 Ni - 0.05 P | 57 | 60 | 66 |
| 1 Ni - 0.2 P | 67 | 77 | 70 |
| 0.5 Ni - 0.1 P | 63 | 78 | 71 |
| 0.25 Ni - 0.25 Sn - 0.02 P | 64 | 66 | 79 |
| 0.5 Ni - 1 Sn - 0.1 P | 74 | 47 | 79 |

Phosphorus reacts with the nickel to form a nickel phosphide that increases the strength of the alloy. Precipitation of nickel phosphide from the copper alloy matrix also leads to an increase in electrical conductivity. In the absence of nickel, a phosphorous addition would reduce electrical conductivity and have a minimal, if any, effect on strength.

The strength increases as a function of the phosphorus content. Below about 0.03%, there is insufficient phosphorus to react with the nickel. Above about 0.35%, there is an excess of phosphorus resulting in the formation of coarse phosphides. Accordingly, the phosphorus content of the alloys of the invention is between 0.03% and 0.2%. Preferably, the phosphorus content is between 0.05% and 0.18% and most preferably between about 0.08% and 0.12%.

The increase in strength, electrical conductivity and stress relaxation resistance is most effective when the ratio, by weight, of nickel to phosphorous is in the range of:

$$Ni:P=4.5:1 \text{ to } 9:1$$

More preferably, the ratio is in the range of 5:1 to 7.5:1 and most preferably about 6.75:1.

With reference to FIG. 1, the composition box for the nickel and phosphorous content of the alloys of the invention is bounded by a minimum phosphorous content line 100, a maximum phosphorous content line 102, a minimum nickel content line 104 and a maximum nickel content line 106. The preferred nickel:phosphorous ratio is bounded by 4.5:1 ratio line 108 and 9:1 ratio line 110.

Referring to both FIG. 1 and Table 1, alloy X (1% Ni, 0.05% P) is outside the preferred composition box and has both a lower yield strength and a reduced resistance to stress relaxation than alloy Z (0.5% Ni, 0.1P) which is within the composition box.

Tin increases the strength and stress relaxation resistance of the alloy, but reduces electrical conductivity. Below about 0.15% of tin, the detrimental decrease in electrical conductivity leads to a less than satisfactory alloy and resistance to stress relaxation is not significantly further enhanced. Accordingly, the tin content of the alloys of the invention is between about 0.15% and 1%. Preferably, the tin content is between 0.2% and 0.7% and most preferably, the tin content is between 0.25% and 0.6%. It is a combination of nickel and tin that effectively improves the resistance of the alloy to elevated temperature stress relaxation.

Zinc contributes additional strength to the alloy. By increasing the zinc content, a smaller cold rolling reduction to final gauge is required after the last in process anneal to achieve a desired strength. As a consequence, formability at a particular strength is enhanced with zinc content. The effect of the zinc addition on the amount of cold work needed to reach 70 ksi yield strength is recorded in Table 2: The bend formability, recorded as minimum bend radius as a function of thickness (MBR/t), is recorded in both the good way (gw) and bad way (bw) orientation. MBR is the minimum radius of a mandrel or die about which a copper alloy strip can be bent to a 900 bend without introducing fracture of the outer surfaces of the bend.

TABLE 2

INFLUENCE OF ZINC CONTENT UPON
REQUIRED COLD WORK AND RESULTING FORMABILITY

| ALLOY (plus Copper) | % COLD ROLLING | YIELD STRENGTH (Relief Annealed) (ksi) | 90° MBR/t gw/bw |
|---|---|---|---|
| 1 Ni - 0.1 P | 60 | 63 | 1.2/.2 |
| 0.5 Ni - 1 Sn - 0.1 P | 60 | 74 | 1.4/2.3 |

TABLE 2-continued

INFLUENCE OF ZINC CONTENT UPON REQUIRED COLD WORK AND RESULTING FORMABILITY

| ALLOY (plus Copper) | % COLD ROLLING | YIELD STRENGTH (Relief Annealed) (ksi) | 90° MBR/t gw/bw |
|---|---|---|---|
| 10 Zn - 0.5 Ni - 0.3 Sn - 0.01 P | 40 | 70 | 0.3/0.3 |
| 20 Zn - 0.5 Ni - 0.5 Sn - 0.1 P | 20 | 70 | S/S |

S = sharp bend, MBR/t of less than 0.1.

Directionality is defined with reference to FIG. 2. A sheet 10 of a desired copper alloy is reduced in thickness by passing through rolls 12 of a rolling mill. The copper alloy sheet 10 then has a longitudinal axis 14 along the rolling direction that is perpendicular to an axis 16 about which the rolls 12 rotate. The transverse axis 18 of the copper alloy sheet 10 is perpendicular to the longitudinal axis 14.

Spring contacts formed from the copper alloy sheet and oriented parallel to the rolling direction are referred to as having a good way orientation and bend movement is in the longitudinal direction. Spring contacts having an orientation transverse to the rolling direction are referred to as having a bad way orientation and bend movement is in the transverse direction.

The zinc addition to the alloy significantly contributes to the successful manufacture of connectors formed over a smaller tool radius at a given strength.

Increasing the zinc content decreases the thermal stability of the brasses of the invention as manifest by the percent stress remaining at a fixed time and temperature. With reference to Table 3, with about 10% zinc, the highest application temperature of an alloy analyzed as containing 10.2% zinc, 0.50% nickel, 0.30% tin, 0.10% phosphorous and the balance copper ("Inventive Alloy A"), using 30% of the initial stress lost criterion, is 150° C. When the zinc content is doubled to about 20%, the highest application temperature of an alloy analyzed as containing 19.8% zinc, 0.5% nickel, 0.51% tin, 0.11% phosphorus and the balance copper ("Inventive Alloy B") is less than 150° C., but above 125° C. As further illustrated in Table 3, the brasses of the invention have a thermal stability improvement over both copper zinc binary alloys and modified copper-zinc alloys.

Copper alloy C510 is a phosphor bronze with a nominal composition by weight of 5% tin, 0.2% phosphorous and the balance copper. C510 is presently widely used to manufacture appliance and automotive electrical connectors; although tin bronze alloys are more costly than brass alloys due to a higher metal value, zinc is less costly than both copper and tin.

TABLE 3

COMPARISON OF THE STRESS RELAXATION BEHAVIOR OF MODIFIED BRASS ALLOYS AND VARIOUS COMMERCIAL ALLOYS PROCESSED TO EQUIVALENT STRENGTHS

| ALLOY | TEMPER | YIELD STRENGTH (ksi) | PERCENT STRESS REMAINING (after 3000 hours) 75° C. | 105° C. | 125° C. | 150° C. |
|---|---|---|---|---|---|---|
| Cu - 2.0% Sn - 0.05% P - 10.3% Zn - 1.92% Ni | CR 60%/RA | 98 | | | 72 | |
| INVENTIVE ALLOY A | CR 40%/RA | 70 | | | 87[1], 85 | 73[1], 71 |
| INVENTIVE ALLOY B | CR 20%/RA | 70 | | | 84[1], 77 | 62[1], 59 |
| Cu - 10% Zn | CR 60%/RA | 68 | | 63 | | |
| Cu - 30% Zn | CR 60%/RA | 85 | | 55 | | |
| C260 | Hard/RA | 72 | 70 | 61 | 48 | |
| C688 | Half Hard | 78 | 75 | | | |
| C425 | ExHard/RA | 75 | | | 76 | 54 |
| C510 | Hard/RA | 72 | | | 79 | 48 |

[1]first value extrapolated from 500 hours, second value, as measured at 3000 hours
CR = cold rolling;
RA = relief anneal
Cu - 2.0% Sn - 0.05% P - 10.3% Zn - 1.92% Ni had an electrical conductivity of 20.8% IACS The zinc content of the alloys of the invention ranges between 2% and the maximum zinc content that effectively maintains an alpha brass microstructure. When the zinc content is less than 2%, the strength benefit achieved by the zinc is minimal. If excess zinc is present, rather than a single phase alpha brass, a dual phase alpha plus beta brass is formed. While the $\alpha/\alpha+\beta$ phase field boundary is about 39% for a copper/zinc binary alloy, the other alloying additions may function as zinc replacements and change the location of the $\alpha/\alpha+\beta$ phase field boundary. Accordingly, a maximum of 35% zinc is generally preferred. More preferably, the zinc content is between 5% and 25% and most preferably between 8% and 12%.

The electrical conductivity of the copper alloys of the invention is affected by the zinc content. While an electrical conductivity of 20% IACS is acceptable for some applications, a minimum electrical conductivity of 25% IACS is preferred. Most preferred is a minimum electrical conductivity of 35% IACS. Increasing the zinc content leads to a decrease in electrical conductivity. FIG. 3 graphically illustrates the effect of zinc content on the resistivity ($\rho$) where:

172.41/ρ=conductivity (in % IACS)

and

ρ=1.68+γ multiplied by (Zn content in weight percent), where y is the resistivity factor from FIG. 3. Thus, FIG. 3 is used to calculate the maximum zinc content that may be included in the alloy for a desired electrical conductivity.

Iron may be added to the alloy in an amount effective to increase strength up to about 0.25%. At an iron content above about 0.25%, the iron combines excessively with the phosphorous to the detriment of nickel phosphide formation. As iron phosphides do not have the same effect on resistance to stress relaxation as nickel phosphides, excess iron leads to a decrease in resistance to stress relaxation. Preferably, the iron content is less than 0.15% and most preferably, the iron content is in the range of from 0.07% to 0.12%.

Oxygen, sulfur and carbon may be present in the alloys of the invention in amounts typically found in either electrolytic (cathode) copper or remelted copper or brass scrap. Typically, the amount of each of these elements will be in the range of from about 2 ppm to about 50 ppm and preferably, each is present in an amount of less than 20 ppm.

Other additions that influence the properties of the alloy may also be included. Such additions include those that improve the free machinability of the alloy, such as bismuth, lead, tellurium, sulfur and selenium. When added to enhance free machinability, these additions may be present in an amount of up to 2%. Preferably, the total of free machinability addition is between about 0.8% and 1.5%.

Typical impurities found in copper alloys, particularly in copper alloys formed from recycled or scrap copper, may be present in an amount of up to about 1%, in total. As a non-exclusive list, such impurities include magnesium, aluminum, silver, silicon, cadmium, antimony, bismuth, manganese, cobalt, germanium, arsenic, gold, platinum, palladium, hafnium, zirconium, indium, antimony, chromium, vanadium, titanium and beryllium. Each impurity should be present in an amount of less than 0.25%, and preferably in an amount of less than 0.1%.

It should be recognized that some of the above-recited impurities, or others, in amounts overlapping the above specified impurity ranges, may have a beneficial effect on the copper alloys of the invention. For example, strength or stampability may be improved. This invention is intended to encompass such low level additions.

One preferred composition for the alloy is:

Nickel 0.25%–1.5%;

Tin 0.15%–0.85%;

Phosphorous 0.033%–0.30%;

Copper 86.6%–91.0%;

Zinc balance;

Where copper plus the other named elements constitute a minimum of 99.5% of the alloy and the Ni:P ratio is from 4.5:1 to 9:1.

The brass alloys of the invention may be manufactured by any suitable process. FIG. 4 schematically illustrates one exemplary process. The alloy is cast by any suitable process, such as commercial DC (direct chill) casting. Typically, the desired amounts of nickel and iron (if iron is required) are added to a molten copper stock first. The molten copper stock may be either a recycled copper, cathode copper or brass alloy scrap or a mixture thereof. Next, the tin is added, followed by zinc, if necessary, and then the more reactive phosphorous is added.

The alloy is then cast 20 and heated for hot rolling 22. A reduction in thickness by hot rolling is typically on the order of from about 50% to about 99%, in thickness, and more preferably on the order of about 70% to about 80%, by thickness. Hot rolling is typically conducted at a temperature of from about 650° C. to about 900° C. The hot rolled strip is optionally quenched following hot rolling.

If the alloy was cast 20 by strip casting, then hot rolling step 22 may be omitted.

Following hot rolling, the surfaces of the strip are milled to remove surface oxides. A sequence 24 of cold rolling 26 and annealing 28 may be conducted either once or multiple times to reduce the thickness of the copper alloy strip by in excess of 90%. In one exemplary process, the strip following hot rolling has a thickness of about 0.5 inch and following the sequence 24, a thickness of about 0.025 inch.

Each cold rolling 26 reduction is on the order of from about 30% to about 95% by thickness. Annealing 28 temperature ranges from about 400° C. to about 850° C. for times of from about 10 seconds to about 5 hours. If the annealing is in the form of a bell anneal, the lower end of the temperature range and longer times are employed. If the annealing is in the form of a strip anneal, the higher end of the temperature range and shorter times are employed.

Preferably, each succeeding annealing in the sequence 24 is at a slightly lower temperature than the preceding anneal. Sequential reduction of annealing temperature improves control of grain size. For example, a first anneal may be at a temperature of 550° C., a second anneal at 525° C. and a third anneal at 450° C.

The microstructure after the first (550° C.) anneal is refined but contains occasional coarse grains. These grains are eliminated by the subsequent annealing steps and the microstructures after the second (525° C.) and third (450° C.) anneals are uniform and fully recrystallized with very fine grains having sizes of less than 5 micrometers (μm) (5 μm=0.005 millimeter) and a uniform dispersion of fine phosphide particles that are less than 0.2 μm and typically smaller than 0.05 μm. This particulate microstructure is distinguished from binary copper/zinc brass alloys that are single phase alloys.

After completion of the sequence 24, a final cold rolling 30 reduces the brass alloy strip to final thickness. For a spring contact, final strip thickness is typically on the order of from about 0.005 inch to about 0.02 inch. The objective of the final cold rolling 30 is to increase strength (temper) and constitutes a reduction, by thickness, of between about 30% and 70%, dependent on the desired final temper.

The final cold rolling 30, that may be anywhere between a 10% and a 95% reduction in thickness, is selected to achieve a desired strength, following relief annealing 32. The amount of thickness reduction in the final cold rolling 30 depends on the zinc content: the higher the zinc content, the smaller the percent reduction required of the final cold rolling 30 operation. While a cold rolling reduction of between 35% and 50% may be required for an inventive brass alloy containing about 10% zinc, a significantly smaller reduction, on the order of 15%–30% by thickness reduction may be effective to provide the same level of strength to an inventive brass alloy containing 20% zinc.

When the strip is at the desired final thickness, a relief annealing 32 at a temperature of between about 225° C. and about 375° C. for from about 1 to about 8 hours, for example 275° C. for 6 hours. The relief annealing relieves residual stresses and thereby improves resistance to stress relaxation. In addition, the relief annealing recovers electrical conductivity and improves ductility.

The brass alloys of the invention will be better understood from the examples that follow.

EXAMPLES

Example 1

A copper alloy (designated in Table 3 as "Inventive Alloy A") having the composition of 10.2% zinc, 0.50% nickel, 0.30% tin, 0.10% phosphorous and the remainder copper was cast as a 5 kg ingot and hot rolled from around 1.8 inches in thickness to about 0.5 inch in thickness with hot rolling starting at a temperature of 850° C. Following milling, the material was cold rolled to 0.10 inch thick, annealed at 550° C. for two hours, cold rolled to 0.050 inch thick, annealed at 525° C. for two hours, and then cold rolled to 0.025 inch thick and annealed at 450° C. for two hours. The strip was then cold rolled to 0.015 inch final thickness and a final relief anneal conducted at 275° C. for two hours. Following the relief anneal, the alloy had a yield strength of 70 ksi, a tensile strength of 74 ksi and an elongation of 9% (for a 2 inch gauge length), all measured at room temperature.

Electrical conductivity was measured to be 36% IACS. The bends were evaluated by determining the minimum radius at which 900 bends could be made without crack development and was determined to be 0.3 t in the good way and 1.2 t in the bad way orientations. This compares very favorably with the 0.5 t for good way and 2.5 t bad way bends for copper alloy C220 (an alloy with a similar zinc content) processed to the same strength, a yield strength of about 70 ksi. As noted in Table 3 above, the highest anticipated service application temperature, utilizing the 70% stress remaining criterion, for this alloy is about 150° C.

The properties of Inventive Alloy A were compared with a number of similar copper alloys. As shown in Table 4, Inventive Alloy A has the best combination of resistance to stress relaxation and high conductivity with bend formability that is comparable to the comparative compositions.

TABLE 4

| Alloy | Temper (per ASTM B601) | % IACS | 0.2% YS | 90° MBR/t gw | 90° MBR/t bw | % S.R. 125° C. | % S.R. 150° C. |
|---|---|---|---|---|---|---|---|
| A | | 36 | 71 | 0.3 | 1.2 | 81 | 70 |
| C663 | HR04 | 25 | 81 | S | 0.6 | 71 | 46 |
| C663 | HR08 | 25 | 96 | 1.2 | 2.5 | 76 | 52 |
| C425 | HR06 | 28 | 75 | 0.3 | 1 | 76 | 54 |
| C50712 | | 32 | 85 | 0.4 | 2.0 | 74 | 67 |
| C4085 | HR06 | 30 | 87 | 0.6 | 1.7 | 73 | 53[1] |
| C4112[2] | HR06 | 40 | 79 | S | 0.5 | NR | 59 |
| C439 | | 19 | 80 | 1.6 | 2.1 | 70[3] | NR |

Notes:
[1]As measured, manuacturer's literature reports 59.
[2]All values from manufacturer's literature.
[3]At 105° C.
YS - Yield stress (0.2% offset)
% S.R. - percent stress remaining following exposure to specified temperature for 3000 hours.
NR - Not reported.
HR04 - Hand temper & relief anneal
HR06 - Extra hard & RA
HR08 - Spring temper & RA
C663 - 10 Zn, 1.8 Sn, 1.7 Fe, 0.3 P, balance Cu (U.S. Pat. No. 5,853,505).
C50712 - 2.2 Zn, 2 Sn, 0.1 Fe, 0.03 P, balance Cu.
C4085 - 2.8 Sn, 0.76 Zn, 0.11 Fe, 0.13 Ni, 0.02 P, balance Cu.
C4112 - 8.5 Zn, 0.5 Sn, 0.1 Fe, 0.1 Ni, 0.03 P, balance Cu.
C439 - 27 Zn, 0.4 Si, 0.5 Sn, balance Cu.

Example 2

A copper alloy (designated in Table 3 as "Inventive Alloy B") having the composition 19.8% zinc, 0.50% nickel, 0.51% tin, 0.11% phosphorous and the remainder copper was cast as a 5 kg ingot and hot rolled from around 1.8 inches to 0.5 inch with hot rolling starting at a temperature of 850° C.

Following milling, the alloy was cold rolled to 0.10 inch thick and annealed at 550° C. for two hours, cold rolled to 0.05 inch thick and annealed at 525° C. for two hours and then cold rolled to 0.025 inch thick and annealed at 450° C. for two hours. The alloy was then subjected to a final cold roll to 0.02 inch and a relief anneal of 275° C. for two hours. The room temperature tensile properties obtained were a yield strength of 70 ksi, a tensile strength of 78 ksi and an elongation of 17% (for a 2 inch gauge length).

The electrical conductivity was measured to be 28% IACS, equivalent to both copper alloys C260 and C425 and better than copper alloy C510 that has an electrical conductivity of 15% IACS.

The formability as measured by the minimum radius at which 90° bends could be made without crack development was determined to be near zero-dimension radius (sharp) in both the good way and bad way orientations. This formability is better than that observed for either copper alloy C260 or copper alloy C425 when at comparable strength. For comparison, copper alloy C510 in the hard, relief anneal temper, that also has a yield strength of between 70 and 75 ksi, typically has a 90° minimum bend radius of sharp in the good way but 0.8 t in the bad way.

As recorded in Table 3, the highest anticipated service application temperature, based on 30% stress lost, is in excess of 125° C., but below 150° C.

It is apparent that there has been provided in accordance with this invention a brass alloy that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A brass alloy, consisting, by weight, of:

from 2% to the maximum that maintains an alpha brass microstructure of zinc;

from 0.2% to 2% nickel;

from 0.15% to 1% tin;

from 0.033% to 0.2% phosphorous;

optional from 0.07% to 0.25% iron;

from about 2 ppm to about 50 ppm of oxygen, sulfur, carbon or a mixture thereof;

less than 2% in total of bismuth, lead, tellurium, sulfur and selenium;

less than 0.25% each and 1% in total of magnesium, aluminum, silver, silicon, cadmium, antimony, manganese, cobalt, germanium, arsenic, gold, platinum, palladium, hafnium, zirconium, indium, antimony, chromium, vanadium and titanium; and the balance copper and inevitable impurities with a nickel:phosphorous weight ratio of between 4.5:1 and 9:1.

2. The brass alloy of claim 1 wherein the nickel:phosphorous weight ratio is between 5:1 and 7.5:1.

3. The brass alloy of claim 2 wherein said nickel:phosphorous weight ratio is about 6.75:1.

4. The brass alloy of claim 2 further including between 0.07% and 0.25% of iron.

5. The copper alloy of claim 2 wherein said zinc is present in an amount of from 8% to 12%.

6. The copper alloy of claim 5 having a composition of:

nickel 0.25%–1.50%;

tin 0.15%–0.85%;

phosphorous 0.033%–0.20%;

copper 86.6%–91.0%; and zinc balance.

7. An electrical connector having a conductivity equal to or greater than 25% IACS and a resistance to stress relaxation at least a 125° C. operating temperature formed from the alloy of claim 6 in a relief anneal temper.

8. The electrical connector of claim 8 having a conductivity equal to or greater than 35% IACS and a resistance to stress relaxation at least a 125° C. operating temperature formed from the alloy of claim 6 in a relief anneal temper.

* * * * *